US009867487B2

(12) United States Patent
Kirkwood

(10) Patent No.: US 9,867,487 B2
(45) Date of Patent: Jan. 16, 2018

(54) HANGER ACCESSORY DEVICE

(71) Applicant: David S. Kirkwood, Pittsburgh, PA (US)

(72) Inventor: David S. Kirkwood, Pittsburgh, PA (US)

( * ) Notice: Subject to any disclaimer, the term of this patent is extended or adjusted under 35 U.S.C. 154(b) by 0 days.

(21) Appl. No.: 15/171,021

(22) Filed: Jun. 2, 2016

(65) Prior Publication Data

US 2016/0270576 A1 Sep. 22, 2016

Related U.S. Application Data

(63) Continuation-in-part of application No. 14/593,025, filed on Jan. 9, 2015, now Pat. No. 9,380,902.

(60) Provisional application No. 61/929,381, filed on Jan. 20, 2014.

(51) Int. Cl.
*A47G 25/14* (2006.01)
*A47G 25/32* (2006.01)

(52) U.S. Cl.
CPC ..... *A47G 25/1428* (2013.01); *A47G 25/14* (2013.01); *A47G 25/32* (2013.01)

(58) Field of Classification Search
CPC ..... A47G 25/14; A47G 25/32; A47G 25/1407–25/1435; A47F 7/19; A41D 27/22
See application file for complete search history.

(56) References Cited

U.S. PATENT DOCUMENTS

| | | | |
|---|---|---|---|
| 1,544,844 | A | 7/1925 | Levkowits |
| 1,575,775 | A | 3/1926 | Lesser |
| 2,610,077 | A | 9/1952 | Swanson |
| 3,124,284 | A | 3/1964 | Collum |
| 3,262,425 | A | 7/1966 | Waugh |
| 3,898,754 | A | 8/1975 | Johansson |
| 4,045,899 | A | 9/1977 | Richardson |
| 4,123,864 | A | 11/1978 | Batts |
| 4,198,773 | A | 4/1980 | Batts |
| 4,221,298 | A | 9/1980 | Wright |
| 4,679,340 | A | 7/1987 | Johansson |
| 4,756,104 | A | 7/1988 | Bailey |
| 4,756,147 | A | 7/1988 | Savell |
| 4,756,204 | A | 7/1988 | Wittwer |
| 4,886,010 | A | 12/1989 | Stutzman |
| 5,499,466 | A | 3/1996 | House |

(Continued)

FOREIGN PATENT DOCUMENTS

| | | |
|---|---|---|
| FR | 2164169 A5 * | 7/1973 |
| GB | 2309115 | 7/1997 |
| JP | 2006223795 | 8/2006 |

*Primary Examiner* — Ismael Izaguirre
(74) *Attorney, Agent, or Firm* — Neustel Law Offices

(57) ABSTRACT

A hanger accessory device for keeping track of how many times an article of clothing has been worn since it was last laundered. The hanger accessory device generally includes a housing having an upper end, a lower end, and a receiver opening extending therebetween. An upper portion of the housing includes markings on its outer surface. A lower portion of the housing includes indentations for removably engaging with a hanger. By rotating the housing around a stem into different locked positions on a hanger, an individual may keep track of how many times an article of clothing has been worn or used between washings by referencing the markings on the different sides of the housing.

19 Claims, 9 Drawing Sheets

(56) References Cited

U.S. PATENT DOCUMENTS

| | | | | |
|---|---|---|---|---|
| 5,564,361 | A | 10/1996 | Satterwhite | |
| 5,586,697 | A | 12/1996 | Johansson | |
| 5,848,729 | A | 12/1998 | Thornton | |
| D421,848 | S * | 3/2000 | Willardson | D20/28 |
| D430,219 | S | 8/2000 | Chagan | |
| 6,330,969 | B1 | 12/2001 | Villaraut | |
| 6,409,057 | B1 * | 6/2002 | Kim | A47G 25/1407 223/85 |
| 6,883,259 | B2 | 4/2005 | Johansson | |
| 7,246,730 | B2 | 7/2007 | Russo | |
| 7,334,359 | B1 | 2/2008 | Palmer | |
| 7,552,849 | B2 * | 6/2009 | Gouldson | A47G 25/1428 223/85 |
| 8,069,595 | B2 | 12/2011 | Aiezza | |
| 8,424,729 | B2 | 4/2013 | Verneau | |
| 8,534,513 | B1 | 9/2013 | Dixon | |
| 8,627,584 | B2 | 1/2014 | Aiezza | |
| 9,380,902 | B2 * | 7/2016 | Kirkwood | A47G 25/1428 |
| 2007/0272716 | A1 * | 11/2007 | Wu | A47G 25/1428 223/85 |
| 2010/0077640 | A1 | 4/2010 | Randall | |
| 2011/0179681 | A1 | 7/2011 | Lamers | |

* cited by examiner

HANGER ACCESSORY DEVICE

CROSS REFERENCE TO RELATED APPLICATIONS

I hereby claim benefit under Title 35, United States Code, Section 120 of U.S. patent application Ser. No. 14/593,025 filed Jan. 9, 2015. This application is a continuation-in-part of the Ser. No. 14/593,025 application. The Ser. No. 14/593,025 application is currently pending. The Ser. No. 14/593,025 application is hereby incorporated by reference into this application.

I hereby claim benefit under Title 35, United States Code, Section 119(e) of U.S. provisional patent application Ser. No. 61/929,381 filed Jan. 20, 2014. The 61/929,381 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a hanger timer and more specifically it relates to a hanger accessory device for keeping track of how many times an article of clothing has been worn since it was last laundered.

Description of the Related Art

Any discussion of the related art throughout the specification should in no way be considered as an admission that such related art is widely known or forms part of common general knowledge in the field.

Clothes hangers have been in use for many decades. Current clothes hangers provide no means for those who use them to keep track of how many times they've worn their clothing since it was last laundered or dry-cleaned. This can be a problem for individuals without the means or desire to wash clothing each time it is worn. For example, pants or trousers need not necessarily be washed every time they are worn, and would benefit from a more routine schedule.

Because of the inherent problems with the related art, there is a need for a new and improved hanger accessory device for keeping track of how many times an article of clothing has been worn since it was last laundered.

BRIEF SUMMARY OF THE INVENTION

The invention generally relates to a clothes hanger accessory which includes a housing having an upper end, a lower end, and a receiver opening extending therebetween. An upper portion of the housing includes markings on its outer surface. A lower portion of the housing includes indentations for removably engaging with a hanger. By rotating the housing around a stem into different locked positions on a hanger, an individual may keep track of how many times an article of clothing has been worn or used between washings by referencing the markings on the different sides of the housing.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
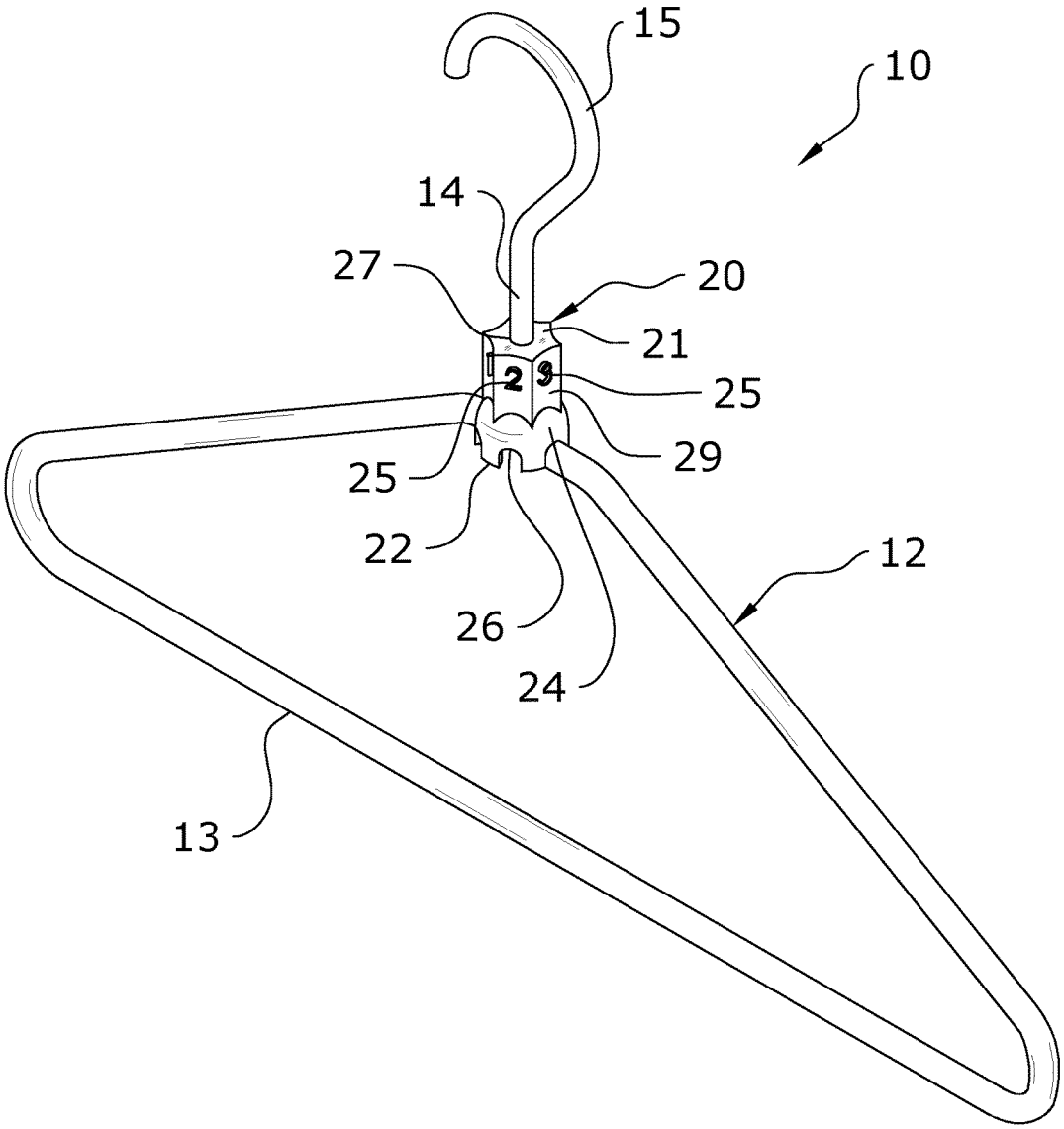
FIG. 1 is an upper perspective view of the present invention installed on a hanger.

Turning now descriptively to the drawings, in which similar reference characters denote similar elements throughout the several views, FIGS. 1 through 15 illustrate a hanger accessory device 10, which comprises a housing 20 having an upper end 21, a lower end 22, and a receiver opening 27 extending therebetween. An upper portion 23 of the housing 20 includes markings 25 on its outer surface. A lower portion 24 of the housing 20 includes indentations 26 for removably engaging with a hanger 12. By rotating the housing 20 around a stem 14 into different locked positions on a hanger 12, an individual may keep track of how many times an article of clothing has been worn or used between washings by referencing the markings 25 on the different sides 29 of the housing 20.

B. Housing

As shown throughout the figures, the present invention generally includes a housing 20 which is adapted to be positioned around the stem 14 of a hanger 12. The shape, size, and configuration of the housing 20 may vary in different embodiments and should not be construed as being limited by the exemplary figures.

In a preferred embodiment as shown in the figures, the housing 20 comprises an elongated structure having an upper end 21 and a lower end 22. When installed on a hanger 12, the upper end 21 is positioned on the stem 14 near the hook 15 and the lower end 22 is positioned on the stem 14 near the base 13. Preferably, the lower end 22 of the housing 20 will include indentations 26 which removably engage with the upper part of the base 13 of the hanger 12 as discussed herein. The length of the housing 20 will vary for different types of hangers 12.

Figure 7:
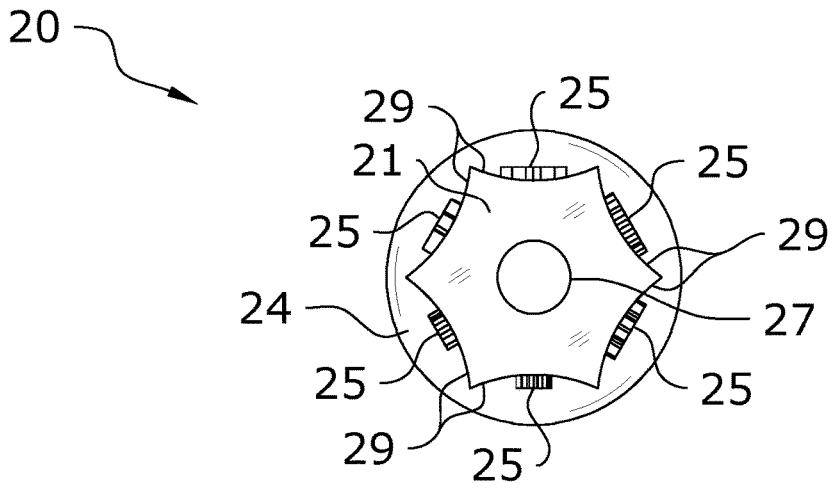
FIG. 7 is a top view of the present invention.
Figure 8:
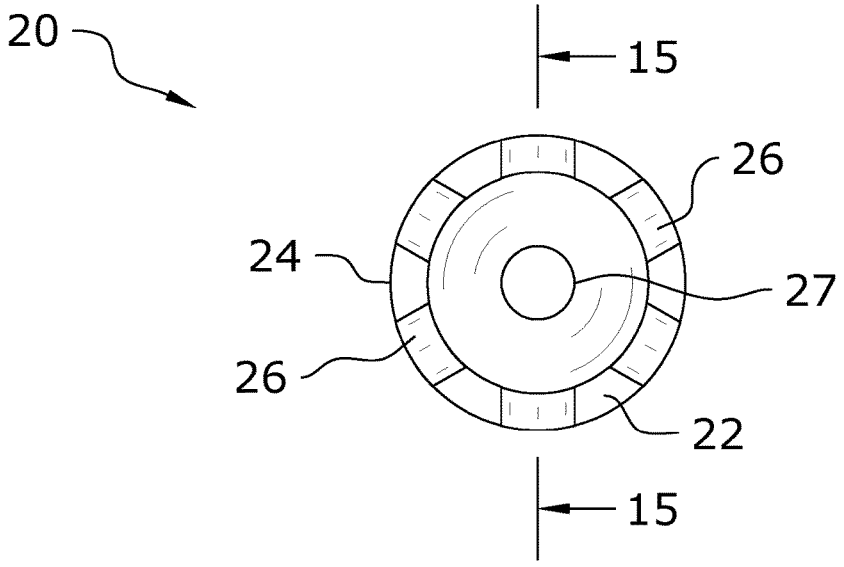
FIG. 8 is a bottom view of a housing having flat sides.

As best shown in FIGS. 7-8, the housing 20 includes a receiver opening 27 which extends through the housing 20 between its upper and lower ends 21, 22. The stem 14 of the hanger 12 fits within the receiver opening 27 when the present invention is in use. The length and width/circumference of the receiver opening 27 may vary for different embodiments. A slot 28 may extend from the receiver opening 27 to the sides 29 of the housing 20 as shown in the figures to aid with positioning the stem 14 within the receiver opening 27.

The cross-section of the receiver opening 27 may also vary and need not necessarily be circular. In some embodiments, the receiver opening 27 comprises a hexagonal cross-section. Such an embodiment works well with hangers 12 having a hexagonal stem 14, as the housing 20 will "click" between multiple positions due to catching on the hexagonal inner surface of the receiver opening 27. This will also prevent the housing 20 from freely rotating about the stem 14.

As shown throughout the figures, the housing 20 is generally separated into an upper portion 23 and a lower portion 24. The upper and lower portions 23, 24 need not be equal in size, so the separation line between the upper and lower portions 23, 24 need not necessarily bisect the housing 20. The upper and lower portions 23, 24 may be integrally formed, or may be interconnected.

Figure 10:
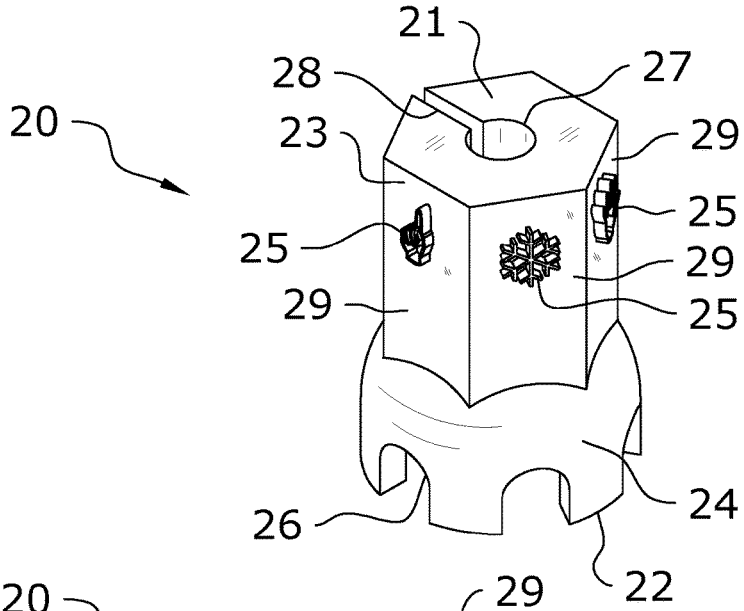
FIG. 10 is a second upper perspective view of a second alternate embodiment.
Figure 11:
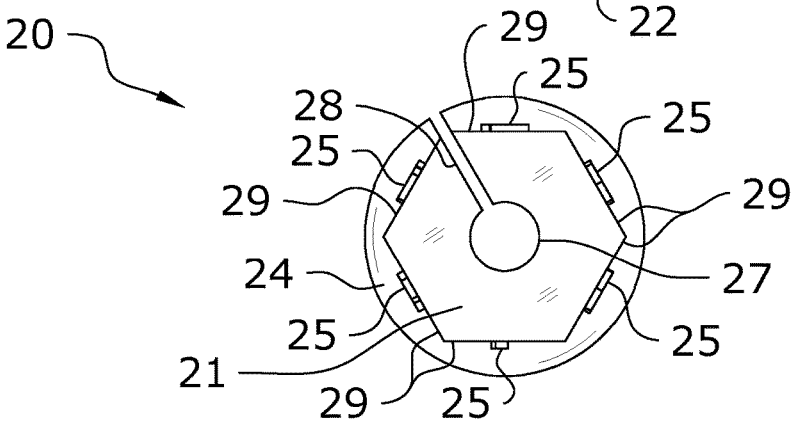
FIG. 11 is a top view of the first alternate embodiment.
Figure 12:
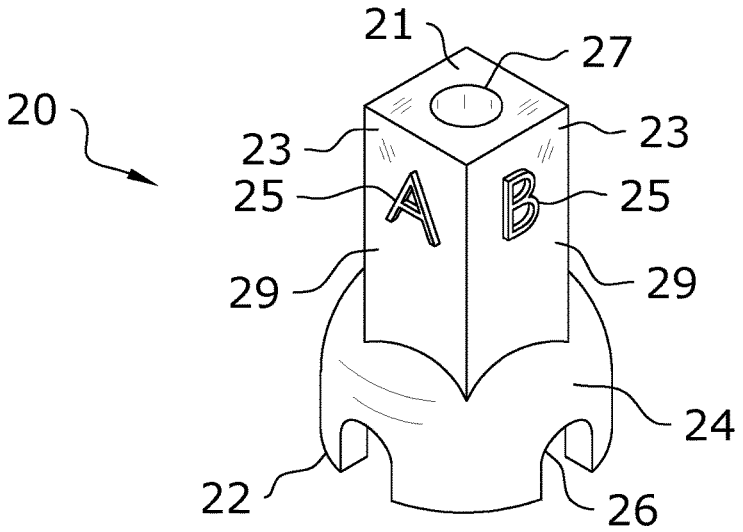
FIG. 12 is a first upper perspective view of a second alternate embodiment.
Figure 13:
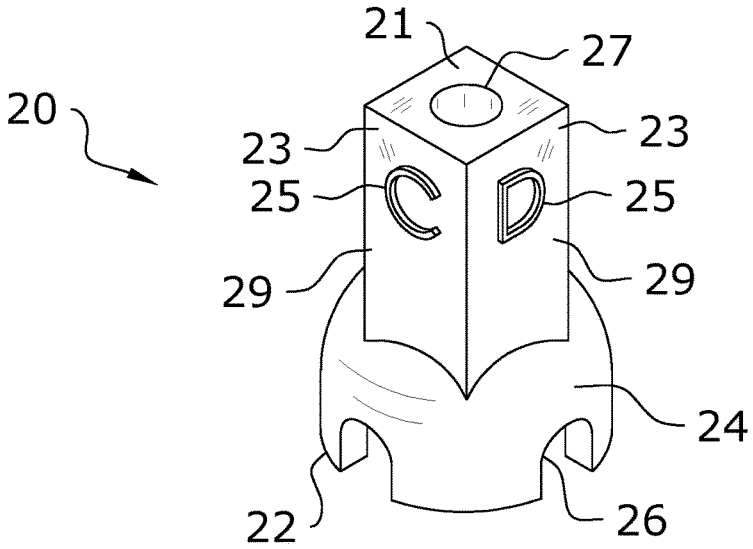
FIG. 13 is a second upper perspective view of the second alternate embodiment.
Figure 14:
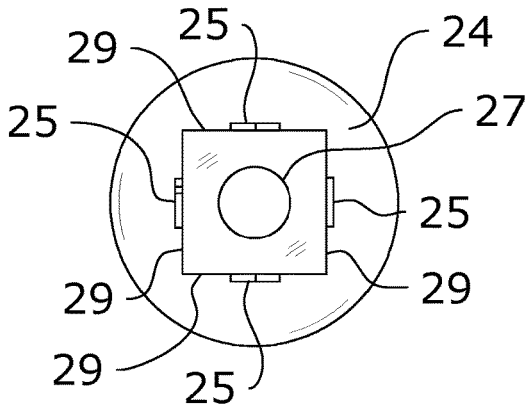
FIG. 14 is a top view of the second alternate embodiment.
Figure 15:
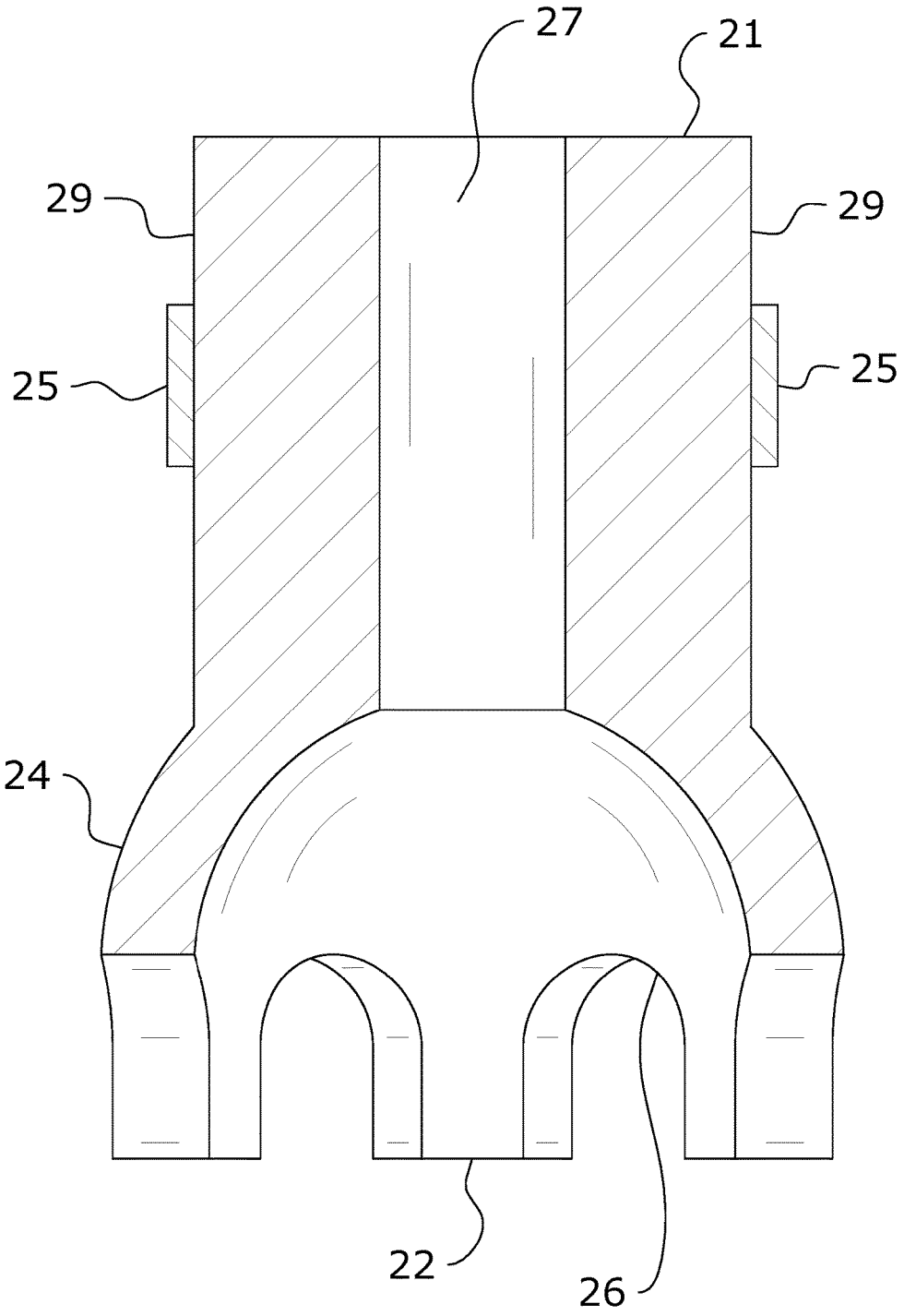
FIG. 15 is a sectional view of the present invention.

The shapes of the upper and lower portions 23, 24 may vary respectively. FIGS. 5-11 illustrate an embodiment in which the upper portion 23 comprises a hexagonal cross-section and the lower portion 24 comprises a circular cross-section. FIGS. 12-14 illustrate an embodiment in which the upper portion 23 comprises a square-shaped cross-section and the lower portion 24 comprises a circular cross-section. These exemplary embodiments of the shape of the upper and lower portions 23, 24 of the housing 20 should not be construed as limiting on the scope of the present invention, as any number of shape combinations may be utilized.

As shown throughout the figures, the housing 20 includes a plurality of sides 29. The number of sides 29 may vary in different embodiments along with the shape of the housing. FIGS. 1-11 illustrate an embodiment with six sides 29. FIGS. 12-14 illustrate an embodiment with four sides 29.

It should also be appreciated that the sides 29 of the housing 20 may be straight-edged as shown in FIGS. 9-14 or may be curved-edged as shown in FIGS. 1-8. It should also be appreciated that curved-edge embodiments may have the sides 29 curve inwards or outwards without affecting overall operation of the present invention.

As shown throughout the figures, the upper portion 23 of the housing 20 generally includes a plurality of markings 25 which are adapted to provide an indicia of prior use of an article of clothing or other object. In some embodiments, the lower portion 24 of the housing 20 may also include a plurality of markings 25. The markings 25 will generally be positioned on the outer surface of the housing 20, such as on its sides 29 as shown in the figures.

As best shown in FIGS. 5, 6, 9, 10, 12, 13, and 15, the lower portion 24 of the housing 20 may include a plurality of indentations 26 for releasably engaging with a hanger 12 to releasably lock the housing 20 in different rotational positions with respect to the hanger 12. The shape, size, configuration, number of, and orientation of the indentations 26 may vary for different embodiments. In the exemplary figures, the indentations 26 comprise a semi-circular shape forming a plurality of arches extending upwardly into the lower portion 24 from the lower end 22 of the housing. Generally, there will be an indentation 26 which corresponds with each of the markings 25 on the housing 20.

Figure 9:
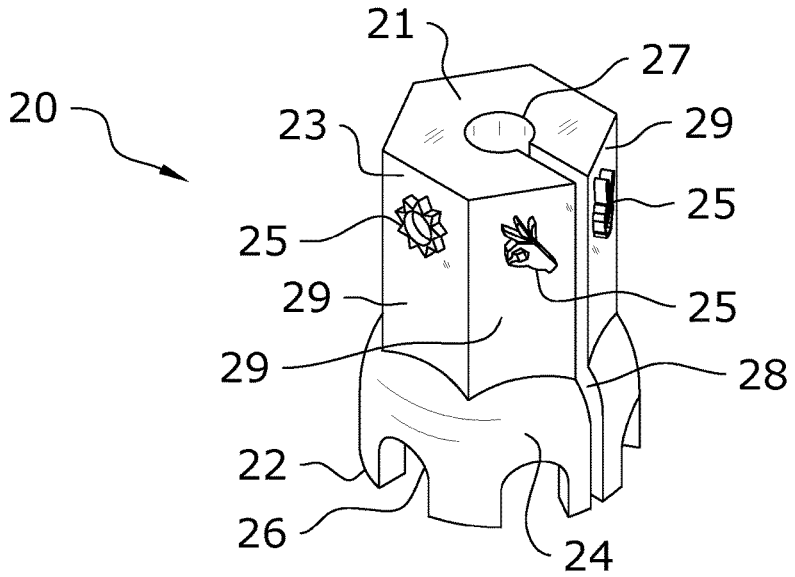
FIG. 9 is a first upper perspective view of a first alternate embodiment.

In a preferred embodiment, the markings 25 will comprise numbers, letters, or other symbols which can be used to determine previous usage of the hanger 12. As shown in the figures, each side 29 of the housing 20 includes a unique marking 25, such as sequential numbering as shown in FIGS. 1-6. An alternate embodiment shown in FIGS. 9-11 illustrates markings 25 which comprise symbols. FIGS. 12-14 illustrate markings 25 which comprise sequential letters. The markings 25 may be printed, engraved, or otherwise disposed on the housing 20 through other methods.

C. Operation of Preferred Embodiment

In use, the housing 20 is first installed on the hanger 12. It should be appreciated that the present invention is adapted for use with various types of hangers 12. Generally speaking, a hanger 12 will include a base 13, a stem 14 extending upwardly from the base 13, and a hook 15 extending from the upper end of the stem 14. An exemplary configuration is shown in the figures, though it should be appreciated that a wide range of hanger 12 designs are compatible with the present invention so long as there exists a portion onto which the housing 20 may be installed. For example, a hanger 12 with a hexagonal stem 14 may be utilized in combination with a housing 20 having a hexagonal receiver opening 27.

To install the housing 20 on a hanger 12, the stem 14 of the hanger 12 is positioned within the receiver opening 27 of the housing 20. The housing 20 may be slid down over the hook 15 and onto the stem 14 in embodiments which omit a slot 28 adjacent to the receiver opening 17. In embodiments including such a slot 28, the stem 14 of the hanger 12 may be inserted through the slot 28 to enter the receiver opening 27 to secure the housing 20 around the stem 14. In some embodiments, the hanger 12 may come manufactured with a housing 20 already positioned around its stem 14.

Figure 2:
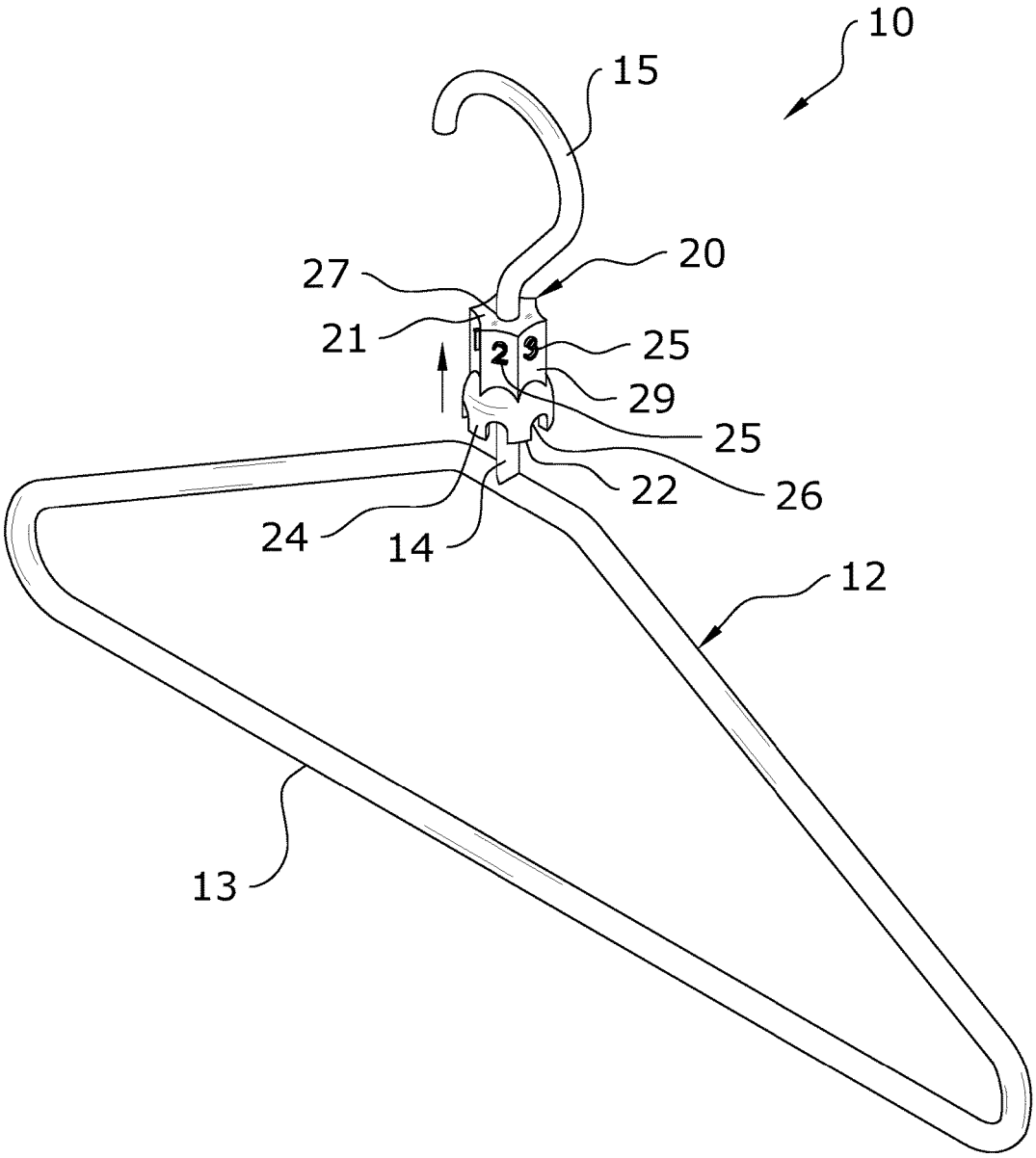
FIG. 2 is an upper perspective view of the present invention being lifted prior to rotation to a different position on the hanger.
Figure 3:
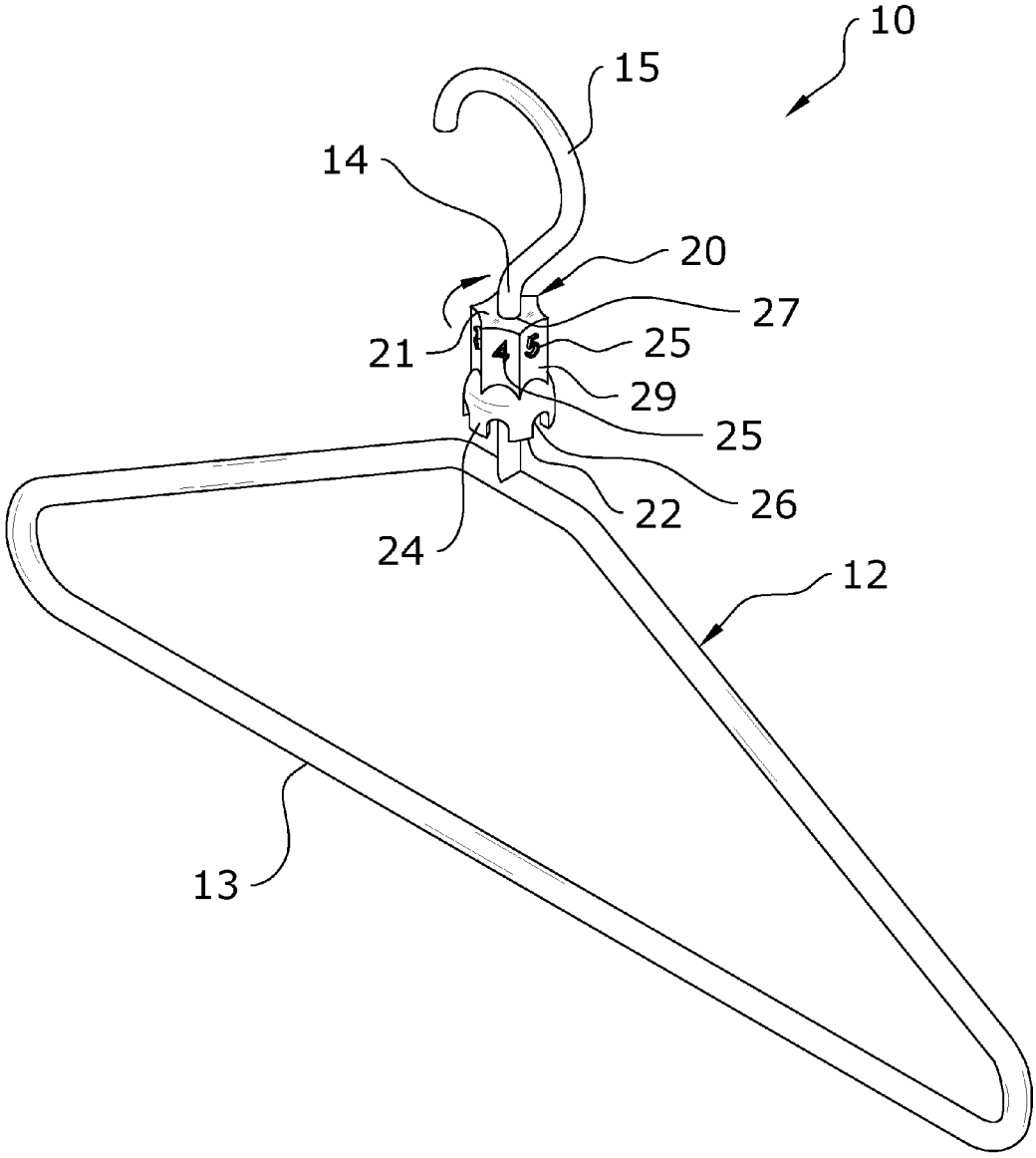
FIG. 3 is an upper perspective view of the present invention being rotated to a different position on the hanger.
Figure 4:
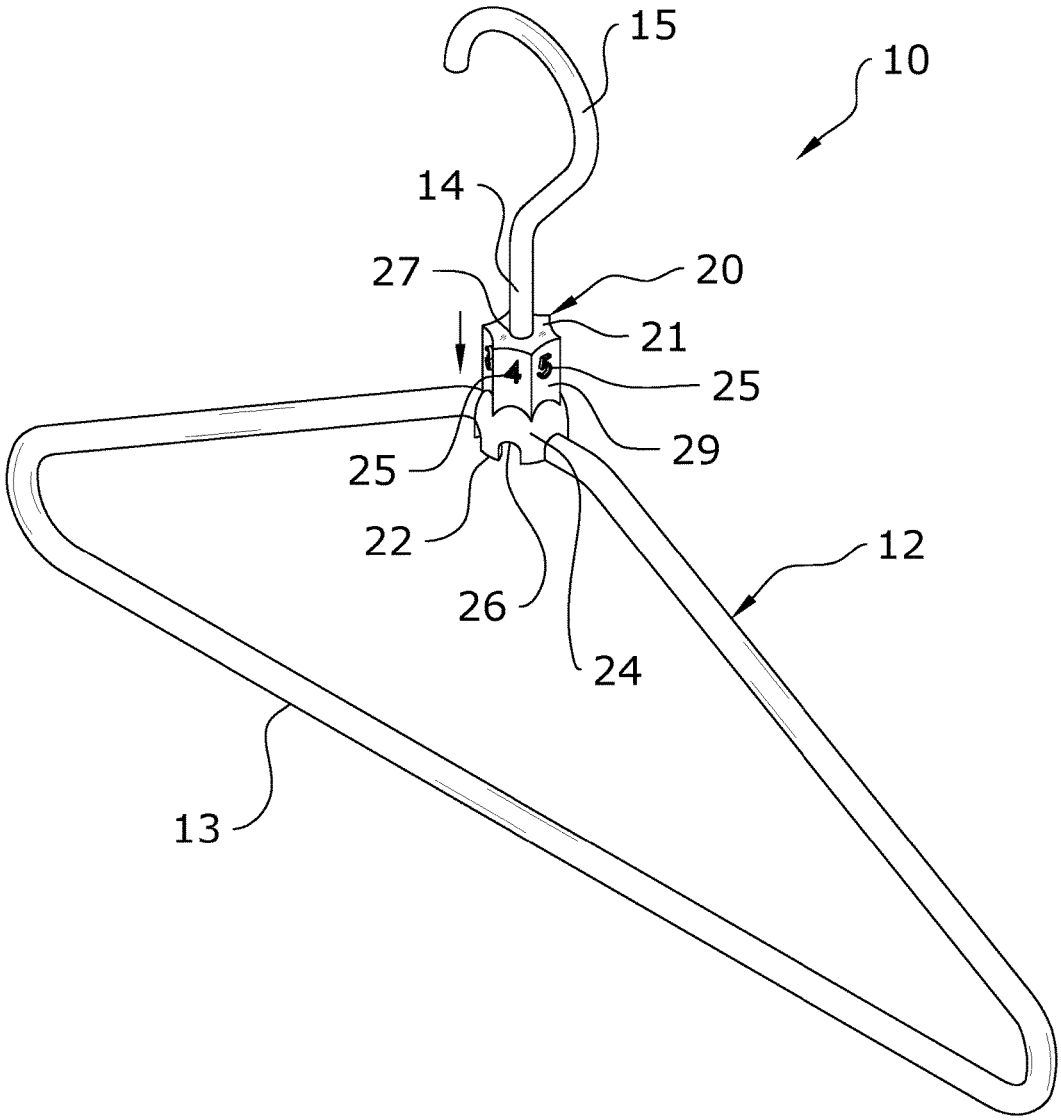
FIG. 4 is an upper perspective view of the present invention being lowered into position on the hanger.
Figure 5:
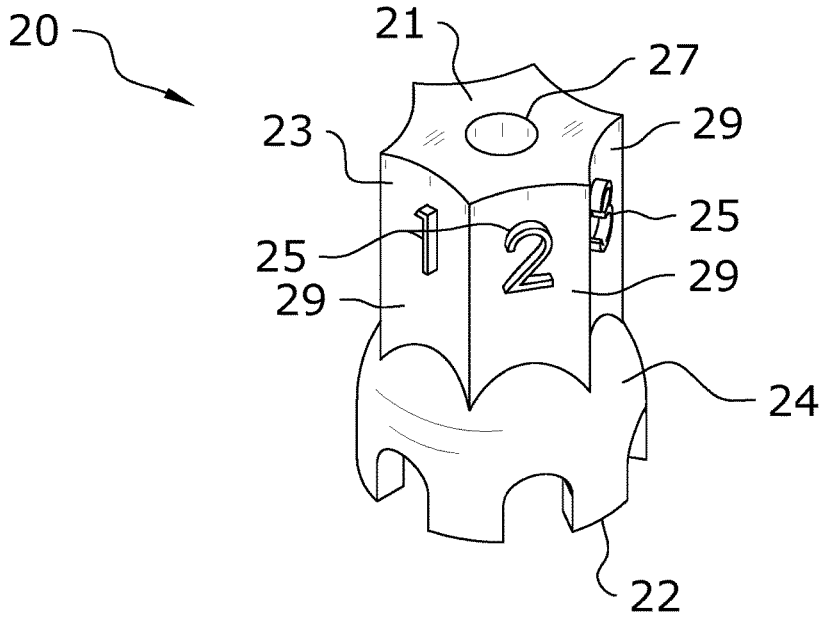
FIG. 5 is a first upper perspective view of the present invention.
Figure 6:
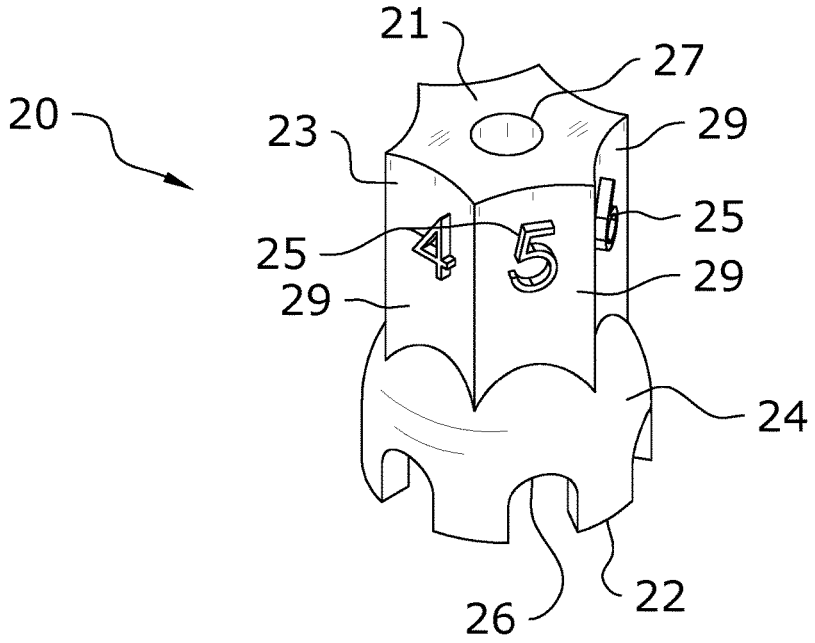
FIG. 6 is a second upper perspective view of the present invention.

With the housing 20 secured around the hanger 12 stem 14 as shown in FIG. 1, the present invention is ready for use. An article of clothing may be placed on the hanger 12 and the hanger 12 stored in a closet or other location. Upon retrieving the article of clothing to wear, the user may rotate the housing 20 one step to change which marking 25 is facing outwardly toward the user. Generally, the user will grasp the housing 20 and pull the housing 20 upwardly as shown in FIG. 2. The housing 20 will then be rotated by one indentation 26 as shown in FIG. 3 and lowered back onto the hanger 12 such that a new set of indentations 26 engage with the hanger 12 as shown in FIG. 4. Thus, the housing 20 will always give a visual representation of how many times the article of clothing has been worn.

This process may be repeated any number of times. Each time the article of clothing is retrieved, the housing 20 may be rotated around the stem 14 to face a different side 28 outwardly and thus expose different markings 25. Upon reaching a set number, the article of clothing may be cleaned and the housing 20 reset to the starting position for the process to be repeated again. Thus, an individual may monitor how many times an article of clothing has been worn prior to cleaning.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A hanger accessory device, comprising:

a housing including an upper end and a lower end;

a receiver opening extending through the housing;

a plurality of markings on the housing, wherein each of the markings is adapted to provide an indicia of prior use of an article of clothing;

a plurality of indentations on the lower end of the housing such that the indentations may engage with a hanger to releasably lock the housing in different rotational positions with respect to the hanger, wherein each of said indentations corresponds with one of said markings.

2. The hanger accessory device of claim 1, wherein the markings are comprised of numbers.

3. The hanger accessory device of claim 1, wherein the markings are on an upper portion of the housing.

4. The hanger accessory device of claim 1, wherein each of the indentations comprise a semi-circular shape.

5. The hanger accessory device of claim 1, wherein the markings are comprised of symbols.

6. The hanger accessory device of claim 1, wherein markings are comprised of letters.

7. The hanger accessory device of claim 1, wherein an upper portion of the housing comprises a hexagonal cross-section.

8. The hanger accessory device of claim 1, further comprising a slot extending from the receiver opening.

9. A hanger accessory system, comprising:

a housing including an upper portion and a lower portion;

a receiver opening extending between the upper portion and the lower portion of the housing;

a plurality of markings on the housing, wherein each of the markings is adapted to provide an indicia of prior use of an article of clothing; and a plurality of indentations on the lower portion of the housing for releasably engaging with a hanger to releasably lock the housing in different rotational positions with respect to the hanger, wherein each of said indentations corresponds with one of said markings, wherein each of said indentations is positioned directly underneath one of said markings.

10. The hanger accessory system of claim 9, wherein the markings are comprised of numbers.

11. The hanger accessory system of claim 9, wherein the markings are on the upper portion.

12. The hanger accessory device of claim 9, wherein the markings are comprised of symbols.

13. The hanger accessory device of claim 9, wherein the markings are comprised of letters.

14. The hanger accessory device of claim 9, wherein the upper portion comprises a square-shaped cross-section.

15. The hanger accessory device of claim 14, wherein the lower portion comprises a circular-shaped cross-section.

16. The hanger accessory device of claim 15, wherein the indentations each comprise a semi-circular shape.

17. The hanger accessory device of claim 16, wherein the receiver opening comprises a circular cross-section.

18. The hanger accessory device of claim 9, further comprising a slot extending from the receiver opening.

19. A hanger accessory system, comprising:

a hanger including a hook and a stem extending from the hook;

a housing including an upper portion and a lower portion;

a receiver opening extending between the upper portion and the lower portion of the housing, wherein the stem of the hanger extends through the receiver opening;

a plurality of markings on the upper portion of the housing, wherein each of the markings is adapted to provide an indicia of prior use of an article of clothing; and a plurality of semi-circular indentations on the lower portion of the housing for releasably engaging with the hanger, wherein each of said indentations corresponds with one of said markings, wherein each of said indentations is positioned directly underneath one of said markings.

* * * * *